US005586693A

United States Patent [19]

De Laforcade

[11] Patent Number: 5,586,693

[45] Date of Patent: Dec. 24, 1996

[54] LIQUID DISPENSER COMPRISING A DISPENSING VALVE AND A PUSH BUTTON

[75] Inventor: Vincent De Laforcade, Rambouillet, France

[73] Assignee: L'Oreal, Paris, France

[21] Appl. No.: 488,738

[22] Filed: Jun. 8, 1995

[30] Foreign Application Priority Data

Jun. 8, 1994 [FR] France ..... 94 07018

[51] Int. Cl.[6] ..... B67D 5/06

[52] U.S. Cl. ..... 222/182; 222/402.1; 222/402.13

[58] Field of Search ..... 222/182, 635, 222/402.1, 402.13

[56] References Cited

U.S. PATENT DOCUMENTS

| | | | |
|---|---|---|---|
| 3,260,416 | 7/1966 | Abplanalp | 222/182 |
| 3,844,448 | 10/1974 | Sette | 222/182 X |
| 4,991,751 | 2/1991 | Naku | 222/402.13 |

FOREIGN PATENT DOCUMENTS

| | | | |
|---|---|---|---|
| 2697812 | 11/1992 | France . | |
| 2112462 | 7/1983 | United Kingdom | 222/402.13 |

*Primary Examiner*—Joseph Kaufman

*Attorney, Agent, or Firm*—Oblon, Spivak, McClelland, Maier & Neustadt, P.C.

[57] ABSTRACT

A dispenser comprises a dispensing valve equipping a container that contains a product to be sprayed. The valve is provided with an actuator stem and the dispenser is of the kind which comprises a push button having a pin capable of acting on the stem. A duct passes through the pin and connects the outlet of the stem to a nozzle provided in the push button. A retaining ring is capable of being fixed on the container for holding the push button in position. The push button is molded in one piece with the retaining ring and is articulated thereto by a swivel joint and at least one tab. The swivel joint connects the push button to the ring in a zone situated in a plane defined by an axis (X) of the container and an axis (Y) of the nozzle and is capable of pivoting round an axis (Z) perpendicular to the axis of the container. The tab is movable in translation solely in the direction of depressing the push button and is situated in a zone of the push button defined by an angular sector of 40° to 140° relative to the axis (Z).

16 Claims, 2 Drawing Sheets

LIQUID DISPENSER COMPRISING A DISPENSING VALVE AND A PUSH BUTTON

BACKGROUND OF THE INVENTION

Field of the Invention

The present invention relates to a dispenser for a product in a liquid form, of a more or less viscous consistency. This dispenser may be used in various fields of use and serve for the dispensing of cosmetic products (such as a varnish, deodorant, hair mousse, body lotion, depilatory mousse, liquid foundation, or sun lotion) or dermopharmaceutical preparations (such as insect repellents, analgesics, or anti-inflammatory preparations) household products, paint etc. in the form of a liquid, spray or foam.

The dispenser of the present invention includes a known container provided with a dispensing valve and which contains the product to be sprayed, the valve being provided with: an actuator stem; a push button comprising a pin capable of acting on the stem; a duct passing through the pin and connecting one end of the stem to a nozzle provided in the push button; and a retaining ring capable of being fixed on the container and provided for holding the push button in position.

DISCUSSION OF THE RELATED ART

A dispenser of this kind has been described by the Applicant in document FR-A-2 661 661. This dispenser allows the dispensing valve to be actuated by exerting a slight force on the push button, which gives the user a feeling of smoothness of operation during the actuation. Moreover, the zone of application of the force has a relatively large angular reach which facilitates the use of this dispenser.

The actuating device (ring-push button) of this dispenser is constituted by two separate parts, which necessitates assembly on a production line and is relatively expensive and complex from an industrial point of view. Another drawback lies in the fact that the valve that can be used for this earlier dispenser is limited to the use of a valve, termed a valve with lateral deformation, which requires a special industrial assembly tool. This results in a high price for the dispenser.

SUMMARY OF THE INVENTION

Thus the present invention aims to simplify the manufacture and the assembly of such a dispenser.

An object of the present invention is to propose a dispenser of the kind defined above whose manufacture and assembly are simpler than those of the device according to the FR-A-2 661 661 document and whose price should be as low as possible.

Thus the present invention provides for a new industrial product constituted by a dispenser for the dispensing of a product in the form of a liquid, a spray or a foam, comprising:

- a reservoir for the product having an axis of symmetry, provided with a dispensing valve, this valve comprising an actuator stem;
- a push button having a pin capable of acting on the stem, a duct passing through the pin and connecting one end of the stem to a nozzle provided with its axis, arranged in the push button; and

- a retaining ring capable of being fixed on the reservoir provided for keeping the push button in position.

The push button and the retaining ring of the present invention are made in one piece and articulated to each other by a swivel joint connecting the push button to the ring in a zone situated in a plane defined by the axes of symmetry of the reservoir and of the nozzle. The swivel joint is capable of pivoting round an axis perpendicular to the axis of the reservoir, and the push button and the ring are, moreover, connected to each other by at least one tab movable in translation along the axis of the reservoir.

The valve that can be used for equipping the dispenser in accordance with the present invention is advantageously a conventional push-down valve. However, a valve with lateral deformation, called a tilt valve, can also be used.

The swivel joint connecting the push button to the ring preferably has the form of a double cone whose zone with the smaller cross-section permits a given rotation round the longitudinal axis of this cross-section, as well as a slight pivoting of the push button in a direction perpendicular to this axis and having as the center of rotation the smaller cross-section zone of this swivel joint, so that a depression of the push button relative to the ring in the direction towards the bottom of the reservoir cannot take place by pressing on a zone of the upper surface of the push button situated opposite the dispensing nozzle.

Advantageously, tho dispenser has several tabs that are movable in translation.

When several tabs are used, these are advantageously 2, 4, 6 or 8 in number and are disposed symmetrically between the ring and the push button.

When only one tab is used, it is disposed in the annular space between the ring and the push button in a zone situated on the opposite side to the swivel joint.

In contrast to the swivel joint, the tab or tabs are unidirectionally movable in translation along the axis of the reservoir towards the bottom of the reservoir.

Advantageously, a first end of each tab is joined to the ring (or the push button), each first end being situated in a plane perpendicular to the axis of the reservoir and containing the axis of the swivel joint; each second end of the tab is thus joined to the push button (or the ring). In the rest position of the push button the attachment points of the first and second ends of each tab are situated at a different level. In other words, the tab or tabs are disposed in the annular space formed between the push button and the ring in the plane perpendicular to the axis of the reservoir and containing the axis of the swivel joint.

This design explains why the push button can be depressed downwards in the direction towards the bottom of the reservoir and is not movable in the opposite direction.

Advantageously, each tab has a cross-section that is not constant between its two ends. Thus the zones with the smaller cross-section constitute bending and straightening zones when the push button is depressed.

The invention also relates to a push button intended to be provided on a dispenser fitted with a dispensing valve as defined above, this push button forming a single piece with its retaining ring, the push button being connected to the ring by a swivel joint, and at least one tab permitting sufficient deflection of the push button to actuate the opening of the valve.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
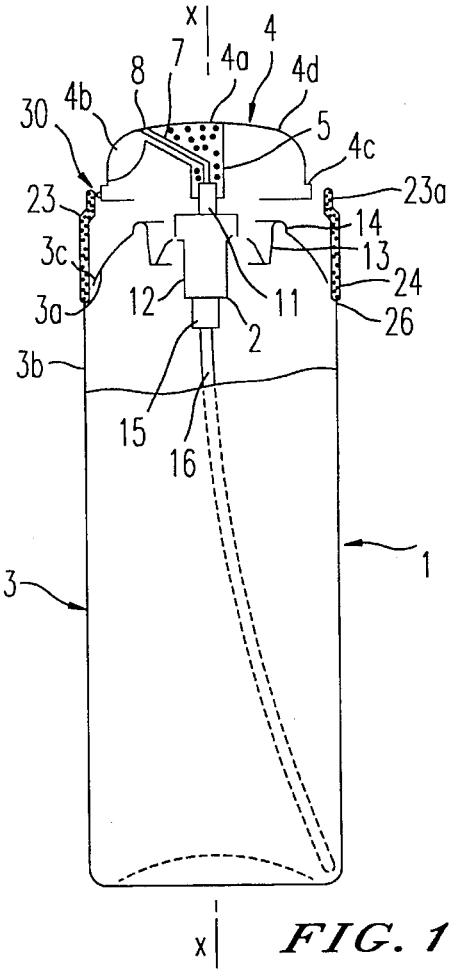
FIG. 1 is a partial sectional view of a dispenser in accordance with the invention.
Figure 3:
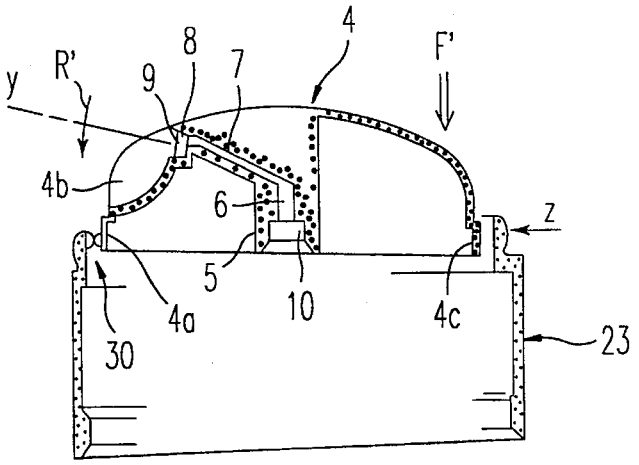
FIG. 3 shows an axial section along line III—III of FIG. 2.
Figure 4:
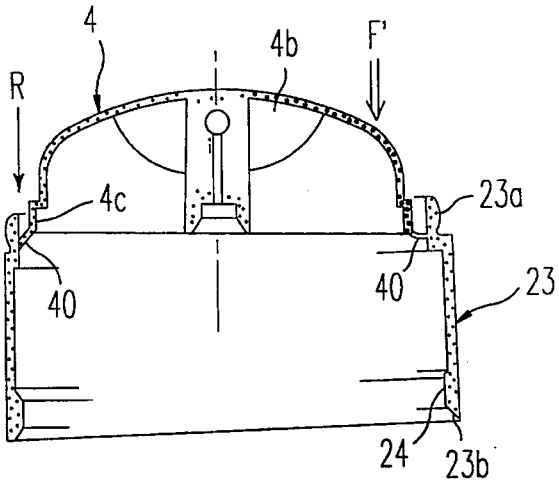
FIG. 4 shows a section along line IV—IV of FIG. 2.

Referring now to the drawings, wherein like reference numerals designate identical or corresponding parts throughout the several views, and more particularly to FIGS. 1 to 6 thereof, a spraying device may be seen, designated by the reference numeral 1 as a whole, comprising a dispensing valve 2 equipping a generally cylindrical reservoir 3 which is pressurized by means of a propellant gas and has an axis X of symmetry. The reservoir 3 contains, for example, a cosmetic or dermopharmaceutical liquid product to be dispensed in the form of an aerosol. It is also possible to use a reservoir fitted with a pouch or a piston whereon a propellant gas is acting indirectly, for dispensing a cream or other product with a more, or less, viscous consistency.

The device 1 has a cap-shaped push button 4 having a peripheral edge 4*c* which has along the axis of its concavity, and hence along the axis X, a cylindrical pin 5 joined to the top 4*a* of the push button 4. The pin 5 is traversed by an axial duct 6 which is connected to a transverse duct 7 leading to a nozzle 8 mounted in the conventional way on a centering component provided in the push button in a recessed zone 4*b*. The free end of the duct 6 has a bore with a larger diameter than the duct 7 so as to form a recess 10 capable of receiving with a slightly tight fit the free end of an actuator stem 11 of the valve 2.

This valve is of the conventional "push down" type whose opening is actuated by the depression of the stem 11 in the direction of the axis X towards the bottom of the reservoir. The valve 2 comprises a body 12 which is crimped at the upper portion on the side of the actuator stem in a cap 13 fixed by crimping or flange mounting on the rolled edge 14 of a circular opening at the upper end of the reservoir 3. On the lower portion of the valve 2, on the opposite side to the actuator stem, the body 12 may be provided with a connection zone 15 with a reduced diameter, extended in a dip tube 16 extending as far as the bottom of the reservoir 3.

Figure 2:
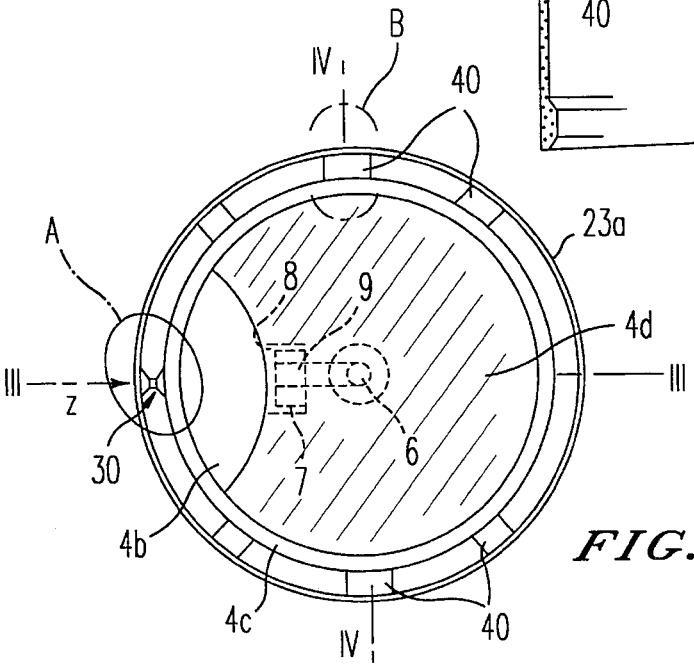
FIG. 2 is a top view on an enlarged scale of the device of FIG. 1, in accordance with a first variant of the embodiment of the invention.

The whole surface 4*a* of the top of the push button 4, with the exception of the recessed zone 4*b*, constitutes a bearing zone 4*d*, represented by cross hatching in FIG. 2, on which bearing zone the user exerts pressure to actuate the opening of the valve 2. The point where the user exerts this pressure is not critical: the device functions by pressing on any point of the bearing surface 4*d*.

The push button 4 with its peripheral edge 4*c* is connected to a first annular edge 23*a* of a securing ring 23 of a generally cylindrical shape by a swivel joint 30 that approximately has the shape of a double cone, and by one or several tabs 40 permitting a given mobility of the push button 4, in the axial direction of the reservoir relative to the ring 23, adequate to actuate the opening of the valve 2. The form of the double cone is not obligatory: as a variant, the swivel joint 30 may be obtained by a simple coupling component whose length/diameter ratio is, for example, between 1 and 3.

The push button 4, the ring 23, the swivel joint 30, and the tabs 40 form a single component which may, for example, be made of polypropylene.

The second annular edge 23*b* of the ring 23 comprises on the inside a catch engagement bead 24, capable of catch engagement in an annular groove 3*c* provided in the transition zone between the cylindrical portion 3*b* of the reservoir 3 and the dome 3*a* surmounting this reservoir and terminating in the rolled edge 14.

Figure 5:
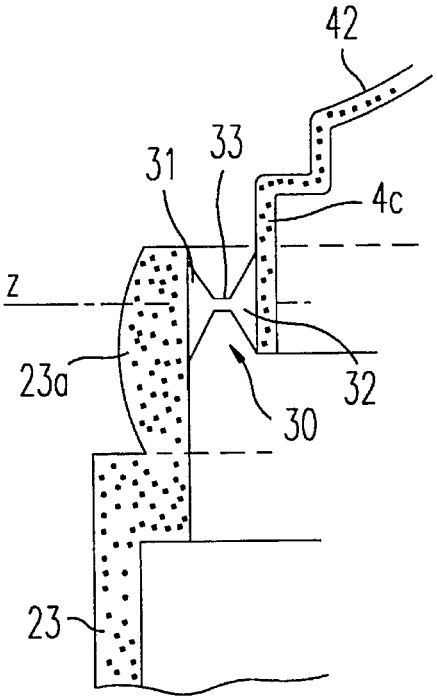
FIG. 5 is a view on an enlarged scale of the indicated portion A of FIG. 2, showing a side view of the swivel joint.

As may be seen in FIGS. 2 and 5, the swivel joint 30 comprises two conically shaped attachment elements 31, 32. The first attachment element 31 is joined to the inner side of the edge 23*a* of the ring 23, and the second attachment element 32 is joined to the peripheral edge 4*c* of the push button 4. The two elements 31, 32 are connected by the tip of the two cones in a zone 33 with a smaller cross-section constituting a bending and/or pivoting zone. The swivel joint 30 is situated in a plane P (the plane of FIG. 3) passing through the center of the nozzle 8 and through the axis X of the reservoir 3.

This arrangement of the swivel joint 30 does not permit a vertical movement of the push button 4, that is to say, a depression, but constitutes a fixed and effective bearing point for the latter, while permitting a slight rotation of the push button round its longitudinal axis X by torsion, when it is actuated by pressing on its bearing zone 4*d*. At the same time, this arrangement permits a slight rotation along the longitudinal axis Z of the double cone having as the center of rotation, the center of the double cone itself.

Moreover, the swivel joint 30 is situated beneath and ahead of the recessed zone 4*b* and in a centered manner relative to this recess.

Figure 6:
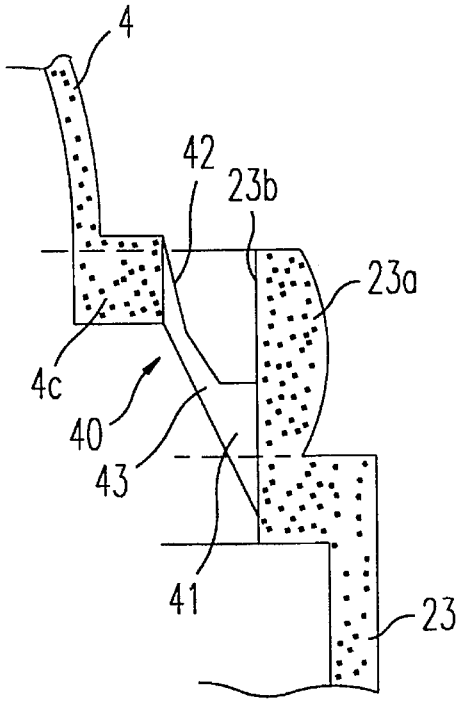
FIG. 6 is a view on an enlarged scale of the indicated portion B of FIG. 2, showing a side view of the tab.

FIG. 6 shows a side view of a tab 40 in its rest position. The tabs 40 are disposed symmetrically relative to the plane P passing through the center X, the center of the nozzle 8, and the swivel joint 30 between the edge 4*c* of the push button 4 and the inner edge 23*b* of the ring 23. Provision may be made for only one tab 40 in the plane P on the opposite side to the swivel joint 30. Preferably 2, 4, 6 or 8 tabs are disposed symmetrically relative to the plane P. In this case, the tabs 40 connecting the push button to the ring 23 are regularly interspaced in an angular zone of approximately 40° to 140°, as shown in FIG. 2.

Each tab 40 is a strip 43 with its thickness decreasing from its point of attachment 41 to the edge 23*a* of the ring 23, at the point of attachment 42 to the edge 4*c* of the push button. The strip 43 has an angular orientation relative to the axis X so that the attachment points 41 and 42 are disposed at two different levels. In particular, the attachment point 42 is situated in the plane R (the plane of the FIGS. 2 and 5) perpendicular to the axis X and containing the axis Z, and the attachment point 41 is at a lower level relative to this plane R. This arrangement inhibits upward movement of the push button 4. The zones of connecting the strip 43 to the attachment points 41 and 42 respectively constitute bending zones which facilitate the bending of each tab 40 when the user exerts pressure on the bearing zone 4*d*, thus allowing the push button 4 to be depressed. It is worthwhile to note that the width of the tabs 40 may be modified according to their number and position relative to the swivel joint 30. As the point of bearing on the zone 4*d* is moved further away from the nozzle, the feeling of operating smoothness of the dispenser increases. Of course, the tabs 40 and the swivel joint 30 are situated in the annular space defined between the ring 23 and the push button 4.

The dispenser 1 may be covered by a protective cup (not shown), fitted on the edge 23*a* of the ring 23, which cap the user removes before use. To dispense the product, the user presses (in the direction of arrow F' in FIGS. 3 and 4) on any zone whatever of the surface 4*d* of the push button causing it to rock round the swivel joint 30. Depending on their distance from the swivel joint 30, the tabs 40 will be subjected to a deflection in the direction towards the valve 2 and cause the latter to open; the liquid will then rise under the pressure of the propellant, via the dip tube 16 into the body 12 of the valve 2, whence it will be passed towards the spraying nozzle 8 through the 10 stem 11, the conduit 6 and the duct 7.

The object of the recess 4*b* cut opposite the nozzle 8 of the push button is to prevent the spraying cone emerging from the nozzle 8 from fouling the push button. Moreover, because of the presence of the swivel joint 30 in the vicinity of this zone 4*b*, if the user inadvertently presses on this recessed zone 4*b* the spraying cannot be started.

Figure 7:
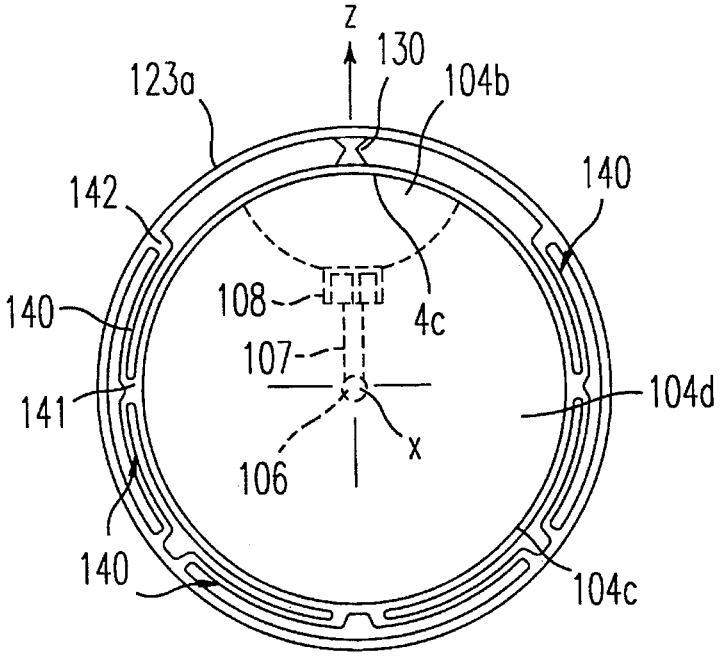
FIG. 7 is a top view of a dispenser in accordance with a second variant of the embodiment of the invention.

FIG. 7 is a view similar to that of FIG. 2 and shows a variant of the embodiment. As compared with FIG. 2 the reference numerals of the components that are identical with, or perform a similar function to, those of FIG. 2 have been increased by 100 and their description will not be repeated. Thus the push button 104, the ring 123 and the swivel joint 130 have the same structure as the corresponding components of FIG. 2. Only the tabs 40 of FIG. 2 have been replaced by tabs 140 of a different shape, disposed in the annular space between the lower edge 104*c* of the push button 104 and the upper edge 123*a* of the ring 123.

Each tab 140 has a first end 141 which forms a point of attachment to the edge 104*c* of the push button 104, and a second end 142 forming a point of attachment to the edge 123*a* of the ring 123. The respective ends 141 and 142 of two consecutive tabs 140 are disposed in a nearby position. The tabs 140 are disposed in the plane R which is perpendicular to the axis X of the reservoir and contains the axis Z passing through the swivel joint 130.

According to another possibility (not shown), the respective ends 141 and 142 of each tab 140 may be disposed in such a way that one end 141 of a first tab 140 should be opposite the end 142 of a consecutive tab 140.

Because of the lever effect produced under the effect of the swivel joint when the valve is actuated, the user will appreciate the comfort of the smooth functioning of the dispenser in accordance with the invention. Moreover, he will exert a smaller bearing force than that necessary for the dispensing of a liquid packaged in a conventional dispenser of this kind.

The solution of the invention, constituted by a push button and an assembly ring formed as a single piece, makes it possible to obtain economies, not only from the point of view of the assembly, but also during manufacture because only a single mold is necessary.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A dispenser for dispensing of a product in the form of a liquid, a spray or a foam, the dispenser comprising:

a reservoir for the product, the reservoir having a first axis of symmetry and being provided with a dispensing valve, the dispensing valve comprising an actuator stem;

a push button having a pin which is capable of acting on the stem, a duct passing through the pin and connecting one end of the stem to a nozzle provided with a second axis, and arranged in the push button; and a retaining ring capable of being fixed on the reservoir for keeping the push button in position;

wherein:

the push button and the retaining ring are made in one piece and articulated to each other by a swivel joint connecting the push button to the ring in a zone situated in a plane defined by the first axis of the reservoir and the second axis of the nozzle, the swivel joint being capable of pivoting round a third axis perpendicular to the first axis, and the push button and the ring being connected to each other by at least one tab movable in translation along the first axis.

2. A dispenser according to claim 1, wherein the valve in a push down valve.

3. A dispenser according to claim 1, wherein the valve is a valve with lateral deformation.

4. A dispenser according to claim 1, wherein the swivel joint has a shape of a double cone with a zone of smaller cross-section which permits a rotation and a pivoting of the push button, so that a depression of the push button relative to the ring cannot take place in a zone opposite the dispensing nozzle.

5. A dispenser according to claim 1, further comprising at least two tabs disposed symmetrically relative to a plane P between the ring and the push button.

6. A dispenser according to claim 5, wherein the tab has a cross-section that is not constant between its two ends.

7. A dispenser according to claim 5, wherein the tab comprises a first end and a second end which are located at different levels of the ring and the push button respectively.

8. A dispenser according to claim 5, wherein a first end of the tab is located in a plane R perpendicular to the first axis and containing the third axis.

9. A dispenser according to claim 8, wherein a second end of the tab is located at a lower level relative to the plane.

10. A dispenser according to claim 7, wherein the first end of the tab is joined to the push button, and the second end is joined to the ring.

11. A dispenser according to claim 9, wherein the first end of the tab is joined to the push button, and the second end is joined to the ring.

12. A dispenser according to claim 7, wherein the tab and its first and second ends are, in a rest position, disposed in an annular space formed between the push button and the ring.

13. A dispenser according to claim 9, wherein the tab and its first and second ends are, in a rest position, disposed in an annular space formed between the push button and the ring.

14. A dispenser according to claim 7, wherein the tab and its first and second ends are disposed in a plane R perpendicular to the first axis and containing the third axis.

15. A push button intended to equip a dispenser provided with a dispensing valve and comprising a retaining ring, wherein the push button forms a single piece with the ring, the push button being connected to the ring by a swivel joint and at least one tab permitting sufficient deflections of the push button to actuate the opening of the valve.

16. A dispenser for dispensing of a product in the form of a liquid, a spray or a foam, the dispenser comprising:

a reservoir for the product, the reservoir having a first axis of symmetry and being provided with a dispensing valve, the dispensing valve comprising an actuator stem;

a push button having a pin which is capable of acting on the stem, a duct passing through the pin and connecting one end of the stem to a nozzle provided with a second axis, and arranged in the push button; and a retaining ring capable of being fixed on the reservoir for keeping the push button in position;

wherein:

the push button and the retaining ring are articulated to each other by a swivel joint connecting the push button to the ring in a zone situated in a plane defined by the first axis of the reservoir and the second axis of the nozzle, the swivel joint being capable of pivoting round a third axis perpendicular to the first axis, and the push button and the ring being connected to each other by at least one tab movable in translation along the first axis.

* * * * *